United States Patent [19]

Abboud

[11] Patent Number: 4,982,645

[45] Date of Patent: Jan. 8, 1991

[54] IRRITANT EJECTING STUN GUN

[76] Inventor: Joseph G. Abboud, 13628 Grover St., Omaha, Nebr. 68144

[21] Appl. No.: 469,035

[22] Filed: Jan. 23, 1990

[51] Int. Cl.[5] ..... F41A 35/00; F41B 15/00; F41C 27/00

[52] U.S. Cl. ..... 89/1.11; 42/1.08

[58] Field of Search ..... 42/1.08; 89/1.11; 222/325; 273/84 ES

[56] References Cited

U.S. PATENT DOCUMENTS

| | | | |
|---|---|---|---|
| 3,374,708 | 3/1968 | Wall | 89/1.11 |
| 3,971,292 | 7/1976 | Paniagua | 89/1.11 |
| 4,058,921 | 11/1977 | Mason | 42/1.08 |
| 4,223,804 | 9/1980 | Morris et al. | 42/1.08 |
| 4,316,338 | 2/1982 | Mason et al. | 42/1.08 |
| 4,486,807 | 12/1984 | Yanez | 273/84 ES |
| 4,843,336 | 6/1989 | Kuo | 42/1.08 |
| 4,846,044 | 7/1989 | Lahr | 89/1.11 |
| 4,884,809 | 12/1989 | Rowan | 42/1.08 |

*Primary Examiner*—David H. Brown

*Attorney, Agent, or Firm*—John A. Beehner

[57] ABSTRACT

An irritant fluid ejecting electrical stun gun includes a housing having a pair of electrical probes protruding from one end and connected to a circuit for directing a high voltage low amperage current to the test probes upon closing a first manual switch on the housing. The housing also includes a recess for removably receiving a storing a replaceable irritant fluid canister positioned relative to an opening through the housing for ejecting irritant fluid through the opening upon movement of a second manual switch to its on position.

6 Claims, 4 Drawing Sheets

IRRITANT EJECTING STUN GUN

BACKGROUND OF THE INVENTION

The present invention is directed generally to an irritant fluid ejecting electrical stun gun and more particularly to such a gun operable single handedly to selectively or simultaneously activate either the electrical stun gun or eject irritant fluid.

There is a need for compact yet effective self defense weapon which one can carry to ward off physical attack by an assailant. Several such devices have been commercially produced but all have limited effectiveness.

Electrical stun guns are known which increase the charge of a nine (9) volt battery approximately five hundred (500) times to create a very high voltage, low amperage charge between protruding electrodes to override the neuro-muscular system of an attacker when the electrodes of the stun gun are pressed against the attacker. Examples of such devices are those marketed under the trademarks COBRA and VIPER by S. K. Electronics of Seoul, Korea. The primary problem with such devices is that one must be close enough to the attacker to touch the attacker in order for the device to work.

Pressurized mace cans for self defense have been available since the 1950's wherein a nozzle on the end of the can is depressed to eject a stream of mace, or another irritant or dye at an attacker. The problem with these devices is that if the wind is in the wrong direction or if the attacker is too close, the user may be incapable of directing the stream of irritant at the attacker.

Other self defense devices are known such as that available under the name TAZER which shoots a projectile but a license is required to carry such a device, much like the license for a gun.

Accordingly, a primary object of the invention is to provide an improved self defense weapon.

Another object is to provide an improved electrical stun gun alternately operable to direct a stream of irritant fluid or the like at an attacker.

Another object is to provide a self-defense device which is effective against an assailant close to or at some distance from the user.

Another object is to provide a self defense device with alternate means for incapacitating an assailant.

Another object is to provide such an improved self defense device which is simple and rugged in construction, economical to manufacture and efficient in operation.

SUMMARY OF THE INVENTION

The irritant fluid ejecting electrical stun gun of the present invention includes a housing having a pair of electrically conductive test probes protruding therefrom at spaced apart positions, which probes are electrically connected in a circuit including means for connecting the circuit to an electrical power source and means interposed between the connector means and test probes for substantially increasing the voltage of current from the power source. A manual switch on the housing is operative to selectively make and break the electrical connection between at least one of the test probes and the means for increasing voltage whereby a high voltage potential is created between the probes upon closing of the manual switch.

The housing furthermore includes a recess for removably receiving and storing a replaceable irritant fluid canister, and an opening through which fluid may be ejected from a canister in the recess. A second manual switch on the housing is movable between on and off positions and co-acts with means for causing irritant fluid to be ejected from the canister upon movement of the second switch to the on position and for blocking the ejection of irritant fluid from the canister upon movement of the second switch to the off position.

The probes preferably protrude from the top end of the housing where they can most easily be pressed against an assailant. The power source is preferably a nine (9) volt battery which is adapted to fit within a small compact housing. The second manual switch is preferably adapted to cause movement of the canister relative to its stationarily supported nozzle for causing ejection of the irritant fluid when the second manual switch is moved to its on position.

DESCRIPTION OF THE PREFERRED EMBODIMENT

Figure 1:
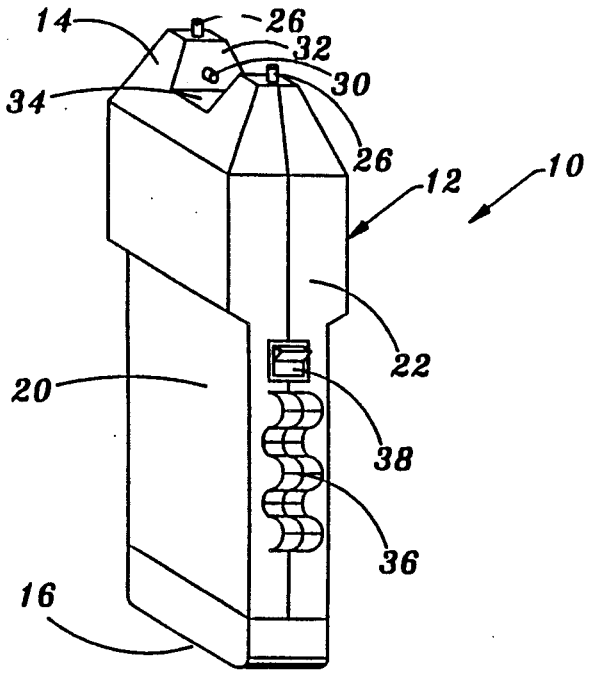
FIG. 1 is a perspective view of the irritant fluid ejecting electrical stun gun of the invention.

The irritant fluid ejecting electrical stun gun 10 of the present invention includes a housing 12 having a top and bottom end 14 and 16 front and rear surfaces 18 and 20 and opposite side edges 22 and 24. A pair of generally L-shaped test probes 26 have exterior ends 28 protruding from the top end 14 of the housing and interior ends 30 protruding toward one another through sidewalls 32 of a recess 34 in the top end of the housing.

Side edge 20 of housing 12 has finger grip ridges 36 formed therein and a first manual switch 38 for making and breaking the electrical connection to the test probes 26. The opposite housing edge 22 has a second manual switch 40 operative to cause irritant fluid to be ejected from the device through an opening 42 (FIG. 7) at the top end of the housing.

The housing 12 may be formed from two half sections 44 and 46, which are secured together by suitable fasteners such as integral locking tabs, screws, or the like. The open bottom of the housing half section is closed by a removable base 48 which affords access both to a battery 50 within the housing as well as to the replaceable mace can 52. Base 48 may be removably attached to the housing by a pair of screws insertable through holes 54 which align with holes in the underside of housing half sections 44 and 46. Removal of base 48 affords access to both the battery 50 and mace can 52 for installing and replacing each when necessary.

Figure 3:
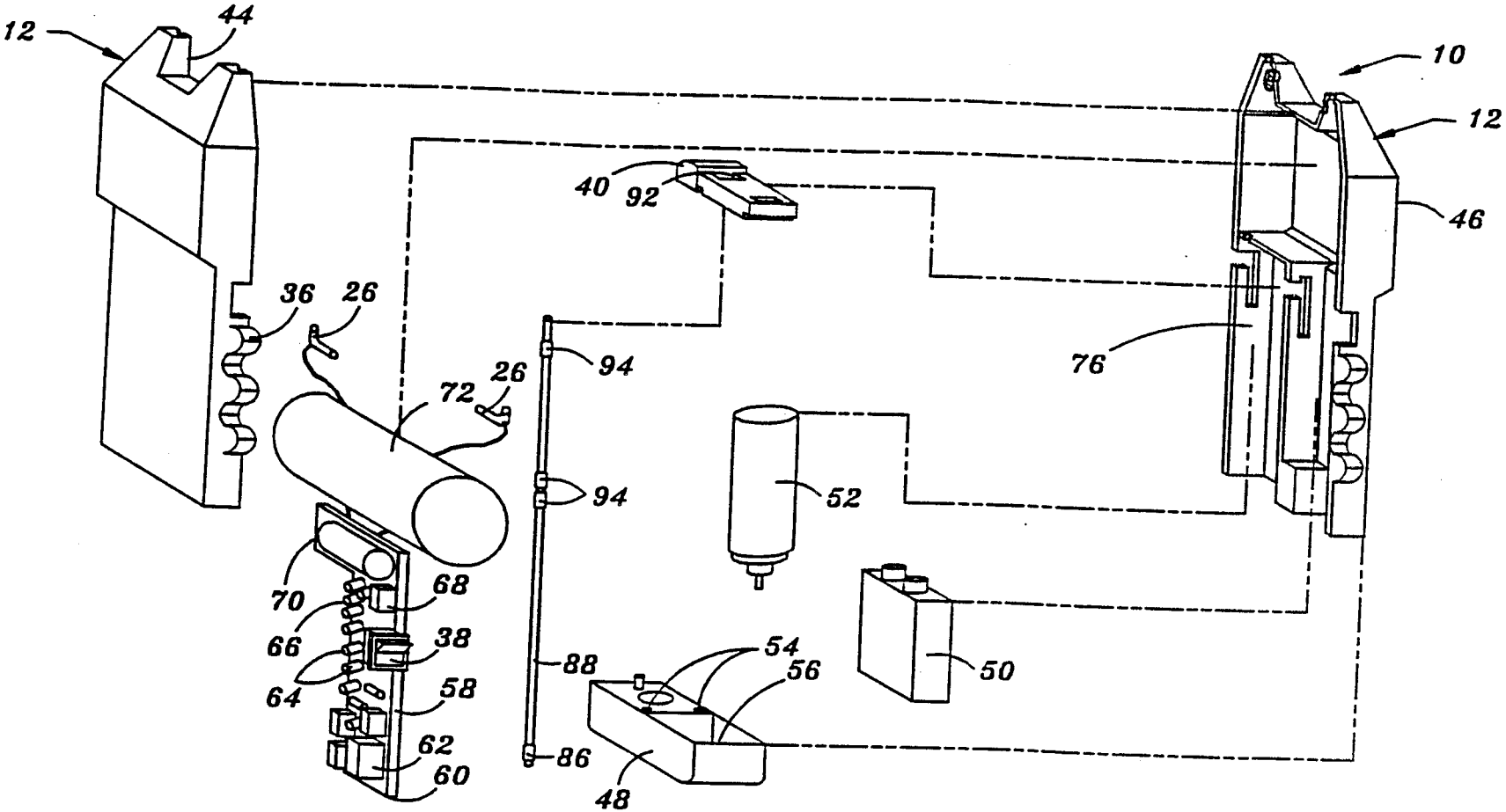
FIG. 3 is an exploded perspective view of the stun gun.

Battery 50 is adapted to be seated within a compartment 56 of base 48 for electrical connection by a standard nine (9) volt battery connector to an electrical circuit 58, elements which are shown best in FIG. 3. Circuit 58 includes a circuit board 60 on which there is mounted a transformer 62, diodes 64, resistors 66, a spark gap 68, capacitor 70, and coil 72, all electrically connected to the test probes 26. A first switch 38 is preferably a rocker switch and is operatively connected in circuit 58 for completing an electrical circuit between the test probes 26 for stunning an assailant when the first switch is pressed on. The switch is biased to an off position when released, both for safety and to preserve battery power. Electrical circuit 58 may be of the type employed in the well known COBRA and/or VIPER stun guns manufactured by S. K. Electronics of Seoul, Korea.

Figure 2:
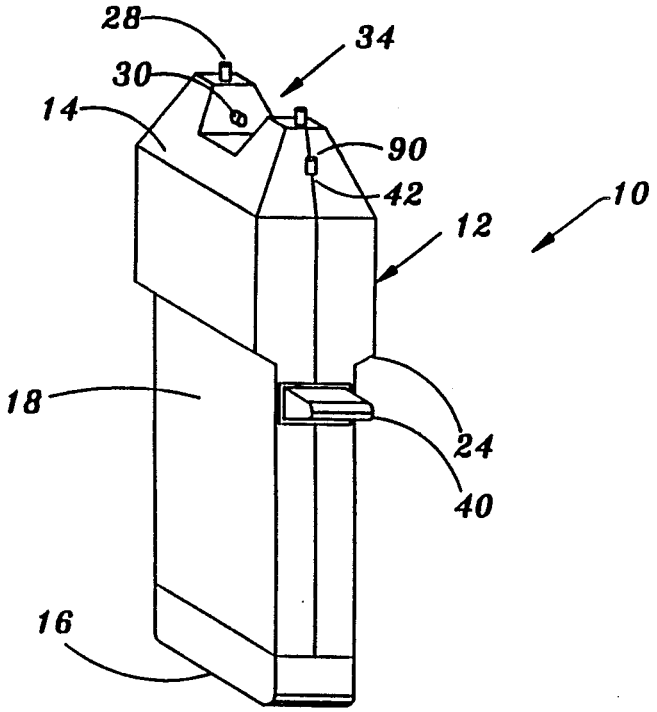
FIG. 2 is a perspective view of the opposite side of the stun gun of the invention.
Figure 4:
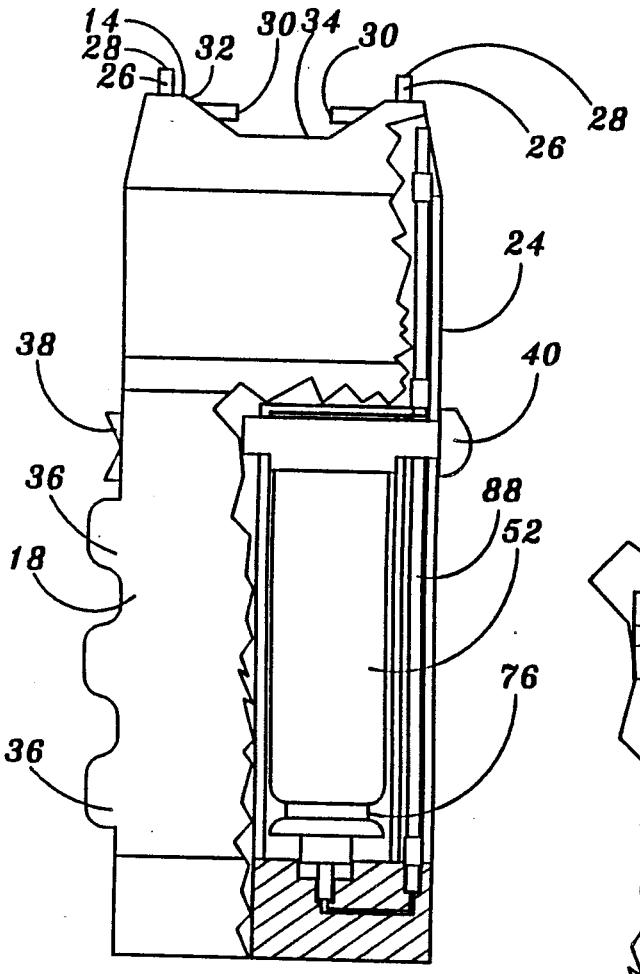
FIG. 4 is a partially sectional front elevational view of the stun gun with portions broken away for clarity.
Figure 5:
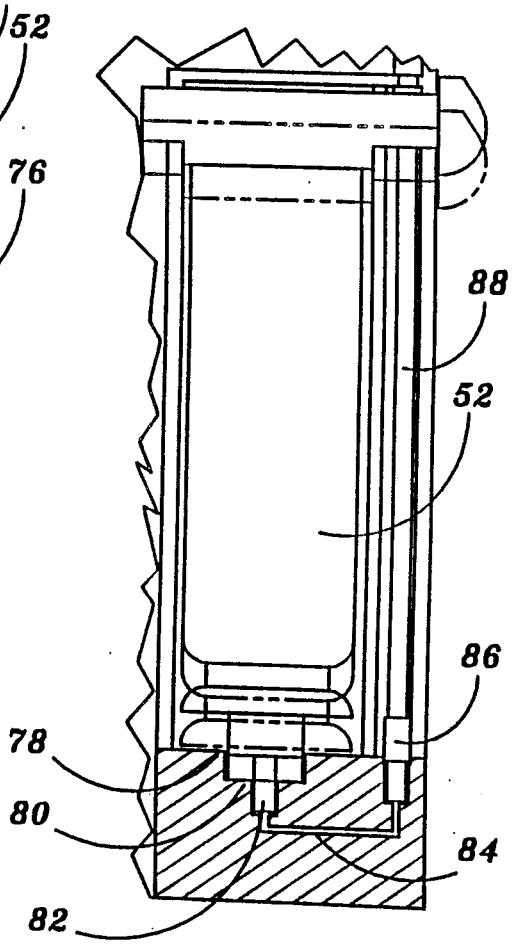
FIG. 5 is a partial enlarged front sectional view of the stun gun showing the movement of the second manual switch and fluid canister for ejecting irritant fluid from the stun gun.
Figure 6:
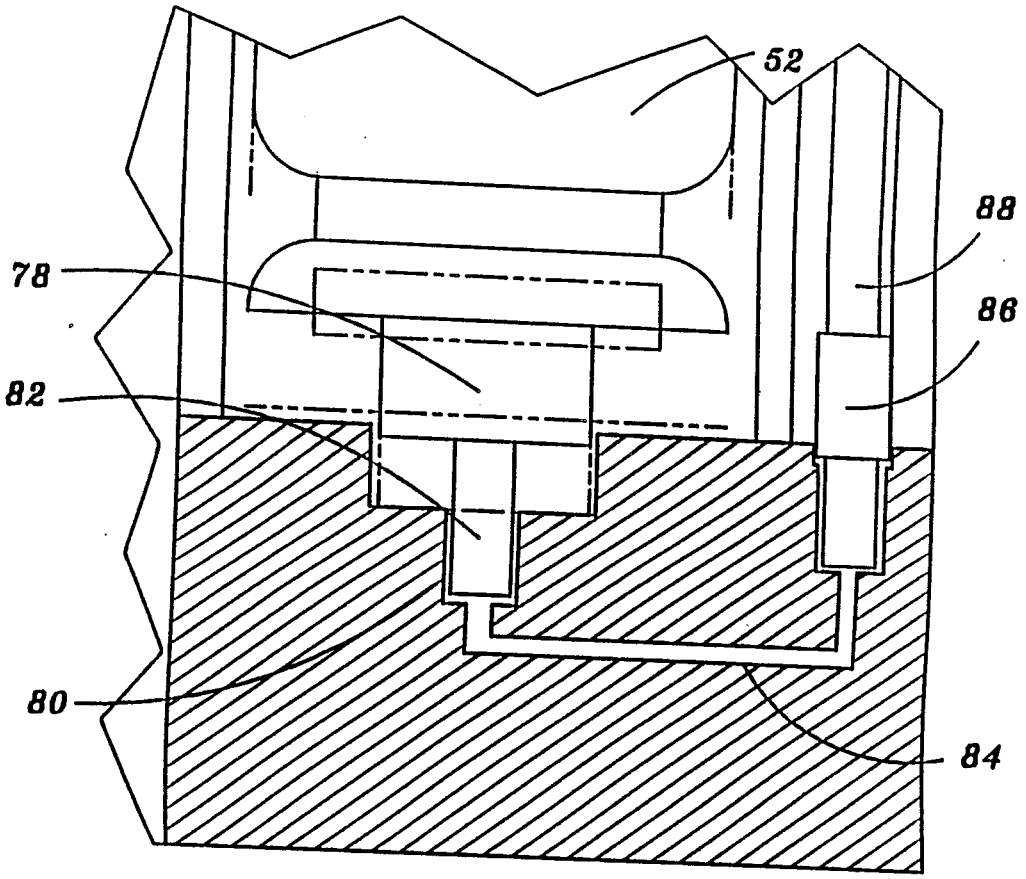
FIG. 6 is a further enlarged detail sectional view of the housing recess and irritant fluid conduit portion thereof.
Figure 7:
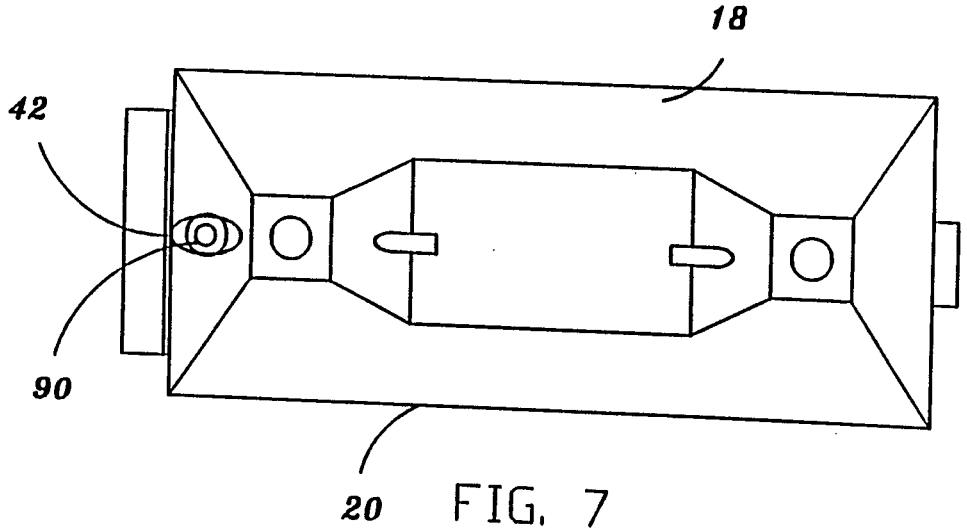
FIG. 7 is a top plan view of the stun gun of the invention.

The ejection of mace or any other irritant fluid is accomplished by another portion of the same stun gun 10. A conventional replaceable pressurized canister 52 of irritant fluid is adapted for storage within recess or compartment 76 in housing 12. The aligned portion of base 48 is provided with a first wide diameter recess 78 (FIGS. 5 and 6) having a smaller diameter recess 80 for stationarily receiving the nozzle 82 of canister 52 placed within the housing 12. Recess 80 communicates with an internal passageway 84, which is connected to a fitting 86 for removable fluid tight connection to an upright conduit 88 (FIGS. 4 and 5). Conduit 88 extends upwardly through housing 12 and terminates at an upper end 90 adjacent to or slightly protruding from the top end 14 of the housing at opening 42, as shown in FIGS. 2 and 7.

Ejection of fluid is accomplished by a finger operated second switch 40. Switch 40 is vertically adjustably supported within housing compartment 76 and is adapted to engage the upper surface of a canister placed in the compartment, as shown in FIGS. 4 and 5. The canister is biased to a non-ejecting position wherein the nozzle 82 protrudes from the canister to the extent indicated in solid lines in FIG. 6. When switch 40 is moved downwardly by an operator's finger, the canister is likewise pressed downwardly to the dotted line position indicated in FIG. 6 whereupon the nozzle, which is stationarily supported within the small recess 80, is forced into the canister resulting in ejection of irritant fluid out of nozzle 82 through passageway 84 and conduit 88, and toward an assailant.

Second switch 40 is preferably a safety switch which requires some type of a double movement for safety. For example it may be necessary to press the switch inwardly toward the housing before it will move down, or the switch may be moveable in a for and aft direction on the side of the housing before it can be pressed downwardly, thereby to prevent accidental ejection of the irritant fluid.

The second switch 40 may have a slot or opening 92 as shown best in FIG. 3 to accommodate passage of the conduit 88 therethrough. As also shown in FIG. 3, conduit 88 may be segmented and include additional fittings 94, as appropriate.

The irritant fluid contained in the canister may be mace, tear gas, any other liquid irritant, a visible dye, or a marking dye which shows up under ultraviolet light, among others.

In operation, an operator need only remove the base 48 from the remainder of the housing for installing a battery 50 and inserting a replaceable irritant fluid canister 52 into the housing. The base 48 is then reattached to the housing which completes the fluid connection between passageway 84 and fitting 86 at the base of the housing conduit 88. The stun gun 10 is then ready for operation. The user need only hold the stun gun comfortably in his or her hand with fingers engaging the ridges 36 of that one index finger is ready to operate first switch 38 for completing the electrical circuit to test probe 26 for stunning any assailant against which they are pressed. Even before an assailant can get close enough to be contacted by the probes, the user's thumb of the same hand in which the stun gun is held, is comfortably positioned to depress second switch 40 to eject a stream of irritant fluid out of conduit 88 through the top end of the housing at an assailant at which the stun gun is pointed. In either event, the user can feel secured knowing that an assailant can be disabled by a stream of mace or other irritant fluid before he contacts the user, and even if a surprise contact is made, the assailant can be disabled with the electrical stun gun feature. When not in use, the small compact size of the stun gun enables it to be conveniently carried in a purse, pocket or the like, where it can be readily grasped when needed.

Whereas the invention has been described in connection with a preferred embodiment thereof, it is apparent that many modifications, additions and substitutions may be made, which are within the intended broad scope of the appended claims.

Thus there has been shown and described an irritant fluid ejecting electrical stun gun which accomplishes at least all of the stated objects.

I claim:

1. An irritant fluid ejecting electrical stun gun, comprising, a housing having top and bottom ends and opposite side edges, a pair of electrically conductive test probes protruding from said housing at spaced apart positions, electrical circuit means in said housing including connector means for connecting said circuit means to an electrical power source, means electrically interposed between said connector means and said test probes for substantially increasing the voltage of current from a power source and a manually operable switch means operative to selectively make and break the electrical connection between at least one of said test probes and said means for increasing voltage whereby a high voltage potential is created between said probes upon closing of said switch means, said housing including a recess for removably receiving and storing a replaceable pressurized irritant fluid canister, said housing including an opening through which irritant fluid may be ejected from a canister in said recess, second switch means on said housing and movable between on and off positions, and said recess, opening and second switch means being positioned on said housing and operatively associated with one another such that upon placement of an irritant fluid canister in said recess and upon movement of said second switch means from the off to the on position, irritant fluid is ejected from said canister into and through said opening.

2. The stun gun of claim 1 wherein an irritant canister has an ejection nozzle moveable between open and closed positions and said housing further comprises a conduit means operative to establish fluid communication between a canister nozzle and said housing opening through which irritant fluid may be ejected.

3. The stun gun of claim 1 wherein said probes protrude out the top end of said housing.

4. The stun gun of claim 3 wherein said switch means and said second switch means and are arranged on opposite side edges of said housing.

5. The stun gun of claim 1 wherein said means for connecting said circuit to an electrical power source comprises means for connecting said circuit to an electrical battery.

6. The stun gun of claim 5 wherein said housing comprises an internal compartment adapted for receiving and storing a battery adapted for connection to said electrical circuit means.

* * * * *